US008505158B2

(12) United States Patent
Han et al.

(10) Patent No.: US 8,505,158 B2
(45) Date of Patent: Aug. 13, 2013

(54) CLEANING APPARATUS AND DUST COLLECTING METHOD USING THE SAME

(75) Inventors: Jung Gyun Han, Gwangju (KR); Myeong Ho Kim, Gwangju (KR); Kyoung Woun Kim, Gwangju (KR); Joo Sung Moon, Gwangju (KR); Hak Bong Lee, Gwangju (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 456 days.

(21) Appl. No.: 12/786,766

(22) Filed: May 25, 2010

(65) Prior Publication Data

US 2010/0313912 A1 Dec. 16, 2010

Related U.S. Application Data

(60) Provisional application No. 61/185,618, filed on Jun. 10, 2009.

(30) Foreign Application Priority Data

Jun. 29, 2009 (KR) ..... 10-2009-0058434
Jul. 8, 2009 (KR) ..... 10-2009-0062246

(51) Int. Cl.
*A47L 9/00* (2006.01)

(52) U.S. Cl.
USPC ..... 15/347; 15/52.1

(58) Field of Classification Search
USPC ..... 15/347–349, 52.1, 340.3, 352, 353
See application file for complete search history.

(56) References Cited

U.S. PATENT DOCUMENTS

| | | | | |
|---|---|---|---|---|
| 2,701,377 | A * | 2/1955 | Luksch et al. | 15/52.1 |
| 3,906,585 | A | 9/1975 | Mattsson | |
| 4,206,530 | A * | 6/1980 | Kroll et al. | 15/346 |
| 5,018,240 | A | 5/1991 | Holman | |
| 8,065,778 | B2 * | 11/2011 | Kim et al. | 15/319 |
| 2008/0047092 | A1 | 2/2008 | Schnittman et al. | |

FOREIGN PATENT DOCUMENTS

| | | |
|---|---|---|
| JP | 2005-102892 | 4/2005 |
| JP | 2006-312066 | 11/2006 |
| KR | 10-0697080 B1 | 3/2007 |
| KR | 10-0711972 B1 | 5/2007 |
| WO | WO 2005/053496 | 6/2005 |

OTHER PUBLICATIONS

International Search Report issued on Jan. 20, 2011, in corresponding PCT International Application No. PCT/KR2010/003708 (3 pages).

* cited by examiner

*Primary Examiner* — Dung Van Nguyen
(74) *Attorney, Agent, or Firm* — NSIP Law

(57) ABSTRACT

A cleaning apparatus and a dust collecting method using the same are provided. The cleaning apparatus includes a body, a brush unit rotatably provided at the body, a dust collecting unit to store contaminants, such as dust, swept by the brush unit, and a blowing unit to suction contaminants, such as dust, scattered by the brush unit and to move the suctioned contaminants to the dust collecting unit.

20 Claims, 12 Drawing Sheets

CLEANING APPARATUS AND DUST COLLECTING METHOD USING THE SAME

CROSS-REFERENCE TO RELATED APPLICATIONS

This application claims the benefit under 35 U.S.C §119(a) of Korean Patent Application No. 2009-0058434, filed on Jun. 29, 2009 in the Korean Intellectual Property Office, and Korean Patent Application No. 2009-0062246, filed on Jul. 8, 2009 in the Korean Intellectual Property Office, and the benefit under 35 U.S.C. §120 of a U.S. Provisional Patent Application No. 61/185,618, filed on Jun. 10, 2009 in the United States Patent and Trademark Office, the entire disclosures of which are incorporated herein by reference for all purposes.

BACKGROUND

1. Field

The following description relates to a cleaning apparatus and a dust collecting method using the same.

2. Description of the Related Art

Generally, examples of cleaning apparatuses include domestic or industrial cleaners, robot cleaners, sweepers for cleaning of offices, factories or roads, and the like. These cleaning apparatuses may include a brush to sweep a floor, or a suction unit to suction dust or dirt.

In one example, a robot cleaner having an automatic traveling function is adapted to remove contaminants, such as dust, etc., from a floor while traveling about a cleaning area without user manipulation. The robot cleaner includes a drive device to cause the robot cleaner to travel about a cleaning area under control, and a cleaning device to remove dust, etc., under control. In addition, the robot cleaner includes a dust collecting unit to store the dust, etc. collected from the cleaning area during traveling of the robot cleaner The robot cleaner may sweep dust, etc. into the dust collecting unit using a brush. After suctioning and filtering the dust, etc. together with air using a suction fan and a filter, the robot cleaner may continuously perform a cleaning operation while collecting the dust in the dust collecting unit and exhausting the air.

However, since the robot cleaner has a limited size, performances of the fan and filter may be changed according to installation positions thereof, and this may have an effect on cleaning performance of the robot cleaner. If the fan breaks down due to contaminants trapped therein or the filter is clogged by the contaminants, the fan or the filter may malfunction, causing deterioration in cleaning performance of the robot cleaner.

Although the robot cleaner as a kind of cleaning apparatus has been described by way of example, various domestic and industrial cleaning apparatuses in addition to the robot cleaner have been sought to realize lower power consumption and higher cleaning performance.

SUMMARY

In one general aspect, there is provided a cleaning apparatus including a body, a brush unit rotatably provided at a central region of the body, a blowing unit provided in a front region of the body to provide suction force, and a dust collecting unit provided in a rear region of the body to store dust, the dust collecting unit including a first inlet provided on a first dust path created by the brush unit, and a second inlet provided on a second dust path created by the blowing unit.

The first inlet and the second inlet may be arranged adjacent to each other, and the second inlet may be positioned higher than a rotation center of the brush unit.

The first inlet and the second inlet may be arranged to face the brush unit.

The dust collecting unit may include a guide member arranged between the first inlet and the second inlet and configured to extend toward the brush unit.

The guide member may be installed in a longitudinal direction of the brush unit and may have a plate shape.

The guide member may be installed in a longitudinal direction of the brush unit and may have a comb shape.

The guide member may be tilted by a predetermined angle with respect to a vertical axis direction thereof.

The dust collecting unit may include a brush cleaning member protruding from the second inlet and having a predetermined portion to interfere with the brush unit.

The brush cleaning member may be installed in a longitudinal direction of the brush unit and may have a comb shape.

The brush cleaning member may be tilted by a predetermined angle with respect to a vertical axis direction thereof.

The dust collecting unit may further include a first storage space provided on the first dust path, a second storage space provided on the second dust path, and a partition to separate the first storage space and the second storage space from each other.

The dust collecting unit may further include a cover arranged above the first storage space and the second storage space, and the cover may include a communication hole to communicate the second storage space and the blowing unit with each other.

The cover may further include a filter member installed at the communication hole.

The dust collecting unit may further include a cover arranged above the first storage space and the second storage space, and the cover may include a connection channel having a first connection hole communicating with the first storage space and a second connection hole communicating with the second storage space.

The first storage space may be larger than the second storage space and the first connection hole corresponding to the first storage space may be larger than the second connection hole corresponding to the second storage space.

The dust collecting unit may further include an opening/closing member to open or close the first inlet and an elastic member to elastically support the opening/closing member.

The opening/closing member may open the first inlet when the dust collecting unit is mounted into the body and may close the first inlet when the dust collecting unit is separated from the body.

The blowing unit may further include a suction port provided on the second dust path and the first inlet and the suction port may be arranged at opposite sides of the brush unit.

The dust collecting unit may include a discharge port, and air introduced into the dust collecting unit by the blowing unit is discharged out of the body through the discharge port.

The dust collecting unit may include a filter member installed at the discharge port.

The blowing unit may guide contaminants, such as dust, scattered by the brush unit, into the dust collecting unit.

The blowing unit may include a suction path communicating with the brush unit, an exhaust path communicating with the dust collecting unit, and a fan arranged between the suction path and the exhaust path.

A flow direction of the suction path may be opposite to a flow direction of the exhaust path.

In another aspect, there is provided a dust collecting method of a cleaning apparatus, the method including sweeping dust with a brush unit installed at a central region of a body, suctioning dust with a blowing unit installed in a front region of the body, and collecting the dust with a dust collecting unit that is installed in a rear region of the body so as to be connected to both the brush unit and the blowing unit.

The brush unit may create a first dust path upon the sweeping of dust, and the blowing unit may create a second dust path upon the suctioning of dust, and the first dust path may extend rearward of the body from the brush unit, and the second dust path may first extend forward of the body toward the blowing unit and then, extend rearward of the body from the blowing unit.

The dust collecting method may further include discharging the dust collected in the dust collecting unit after separating the dust collecting unit.

The dust collecting method may further include discharging the dust collected in the dust collecting unit in a mounted state of the dust collecting unit.

Other features and aspects will be apparent from the following detailed description, the drawings, and the claims.

Figure 1:
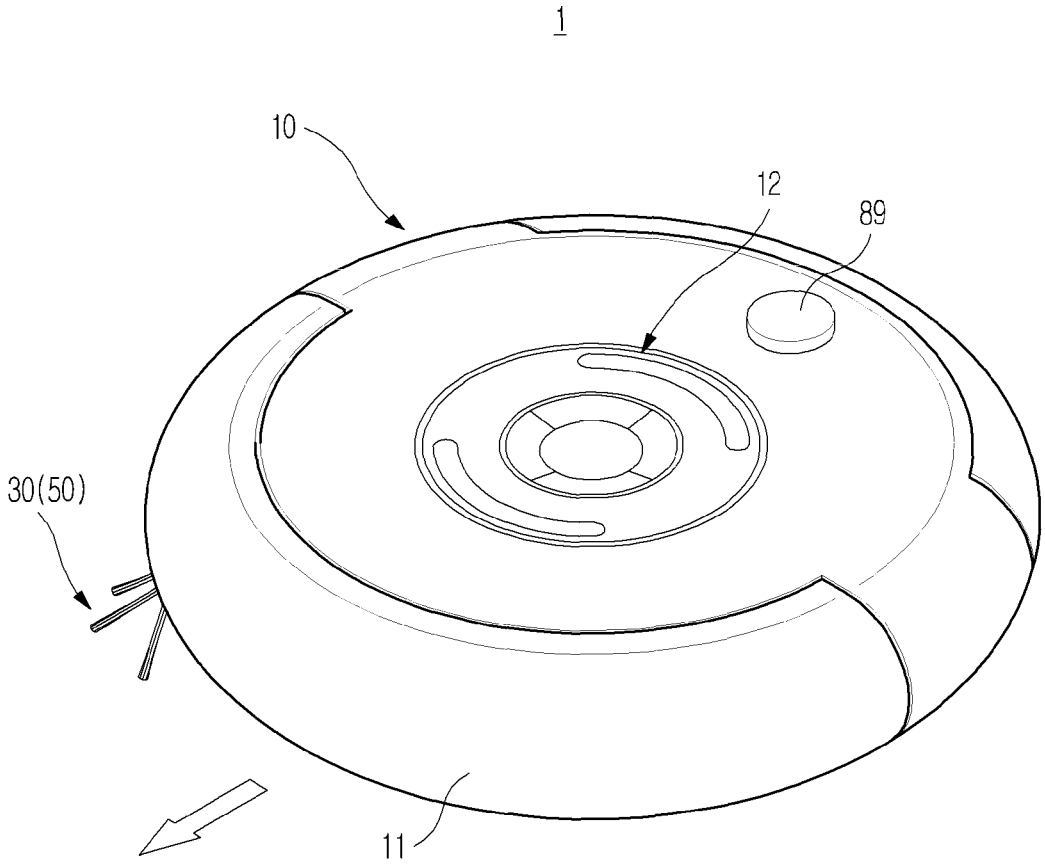
FIG. 1 is a top perspective view illustrating an example of a robot cleaner.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following detailed description is provided to assist the reader in gaining a comprehensive understanding of the methods, apparatuses, and/or systems described herein. Accordingly, various changes, modifications, and equivalents of the systems, apparatuses and/or method described herein will be suggested to those of ordinary skill in the art. Also, descriptions of well-known functions and constructions may be omitted for increased clarity and conciseness.

Figure 2:
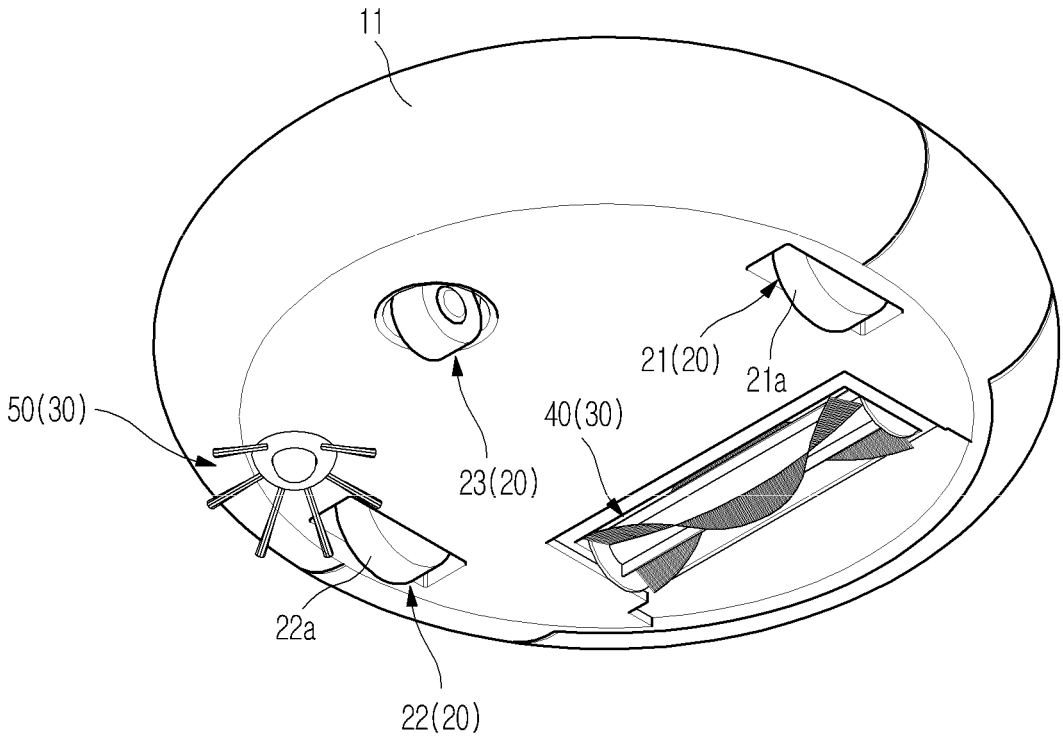
FIG. 2 is a bottom perspective view illustrating an example of the robot.
Figure 3:
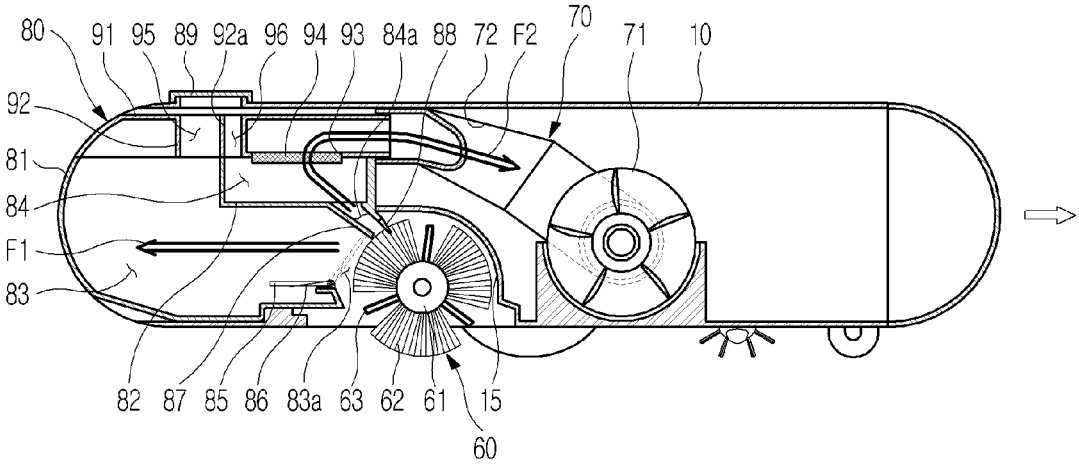
FIG. 3 is a sectional view illustrating an example of the robot cleaner.

FIG. 1 illustrates a top perspective view of an example of a robot cleaner. FIG. 2 illustrates a bottom perspective view of an example of the robot cleaner. FIG. 3 illustrates a sectional view of an example of the robot cleaner.

As shown in FIGS. 1 to 3, for example, the robot cleaner 1 includes a body 10, a drive device 20, a cleaning device 30, and a control unit (not shown). The drive device 20 may be a mechanism mounted to the body 10 to drive the robot cleaner 1. The cleaning device 30 may be a mechanism mounted to the body 10 to clean a floor immediately underneath or around the robot cleaner 1. The control unit may provide commands to the various elements of the robot cleaner 1. The commands may be based on sensor signals or sequence control signals, enabling an automated cleaning operation of the robot cleaner 1.

The body 10 supports various elements of the robot cleaner 1 mounted thereto. The drive device 20 and the cleaning device 30 may be mounted to the body 10 and in addition, various sensors including, e.g., a contact sensor and a proximity sensor to sense the presence of an obstacle may be mounted to the body 10. In one example of the contact sensor, a bumper 11 attached to a front end of the body 10 may be used to sense an obstacle, such as a wall, for example. In one example of the proximity sensor, an infrared sensor (or an ultrasonic sensor) attached to the bottom of the body 10 may be used to sense an obstacle, such as stairs, etc. The body 10 may be provided with a display unit 12 to indicate visible information related to status and operations of the robot cleaner 1.

The drive device 20 may include a left drive wheel assembly 21, a right drive wheel assembly 22, and a caster wheel assembly 23. The left and right drive wheel assemblies 21 and 22 and the caster wheel assembly 23 are coupled to the body 10 and serve to drive the robot cleaner 1 while supporting the robot cleaner 1. The control unit provides the drive device 20 with an operating command to drive left and right wheels 21*a* and 22*a* forward or rearward, enabling change in a movement direction of the robot cleaner 1. In one example, the control unit may drive the respective left and right wheels 21*a* and 22*a* in the same manner, to move the robot cleaner 1 forward or rearward. In another example, the control unit may drive the left and right wheels 21*a* and 22*a* differently, to turn the robot cleaner 1 leftward or rightward on the basis of the movement direction of the robot cleaner 1, or to rotate the robot cleaner 1 about its own axis.

The cleaning device 30 may include a main cleaning assembly 40 and an edge cleaning assembly 50. The main cleaning assembly 40 is arranged at the bottom of the body 10 to clean the floor immediately underneath the robot cleaner 1. The edge cleaning assembly 50 is arranged at one side of the body 10 to clean an area around the robot cleaner 1. In particular, the edge cleaning assembly 50 may move dust or debris around the robot cleaner 1 into the movement path of the robot cleaner 1. Subsequent to operation of the edge cleaning assembly 50, the main cleaning assembly 40 may remove the dust or debris from the movement path of the robot cleaner 1 while moving in the movement path of the robot cleaner 1.

The main cleaning assembly 40 may include a brush unit 60, a blowing unit 70, and a dust collecting unit 80. The brush unit 60 and the blowing unit 70 may act complementary to each other according to a size of contaminants so as to perform a cleaning operation. The brush unit 60 may sweep relatively large dust or debris into the dust collecting unit 80, and the blowing unit 70 may suction relatively small dust or debris to store the suctioned dust or debris in the dust collecting unit 80. In particular, the blowing unit 70 may suction dust or debris scattered by the brush unit 60 and thereafter, move the suctioned dust or debris into the dust collecting unit 80. The dust collecting unit 80 may store the dust or debris collected and suctioned by the brush unit 60 and blowing unit 70.

The brush unit 60 may be rotatably mounted, for example, at a central region of the body 10 behind the drive wheel assemblies 21 and 22. A drum case 15 of the body 10 may be configured to surround the brush unit 60. The brush unit 60 may include a motor (not shown), a roller 61, a brush 62, and at least one flap 63. The roller 61 may be made of steel and may be rotatably coupled to the body 10 so as to be driven by the motor. The brush 62 may be made of an elastic material and may be partially embedded in the roller 61. The at least one flap 63 may be made of an elastic material and may be arranged in a longitudinal direction of the roller 61. The materials described above from which the roller 61, brush 62 and at least one flap 63 may be made, are provided for the purposes of example only. Other suitable materials may be used in addition to those listed above.

The at least one flap 63 may include a plurality of flaps spaced apart from one another by a predetermined distance. The plurality of flaps 63 serves to increase a winding diameter of contaminants, such as hairs, for example, while minimizing friction of the contaminants. Specifically, when contaminants are wound on the plurality of flaps 63 rather than being directly wound on the roller 61, the brush unit 60 may have minimized contact friction with the contaminants, and this may reduce energy required to remove the contaminants.

The brush 62 is driven along with the roller 61 during traveling of the robot cleaner 1, thus acting to sweep dust or debris on the floor. In this case, relatively large dust or debris may be collected in a first storage space 83 through a first inlet 83*a* of a dust container 81. In addition, relatively small dust or debris may be scattered and float between the brush unit 60 and the drum case 15, thereby being suctioned into a second storage space 84 through a second inlet 84*a* of the dust container 81 by suction force of the blowing unit 70.

The blowing unit 70 may be arranged in front of the brush unit 60, i.e., in a front region of the body 10. The blowing unit 70 may include a fan 71, a suction path 72, and an exhaust path (not shown). The fan 71 may be connected to the suction path 72, serving to create suction force in the suction path 72. Since the suction path 72 communicates with the second storage space 84, the fan 71 may also serve to create suction force in the second storage space 84. Thereby, the dust or debris scattered by the brush unit 60 may be collected into the second storage space 84 through the second inlet 84*a* by suction force of the fan 71. The exhaust path allows air suctioned by the fan 71 to be discharged out of the body 10. In one example, the exhaust path may serve to cool electronic elements arranged on the exhaust path that generate heat, such as a motor (not shown).

Figure 4:
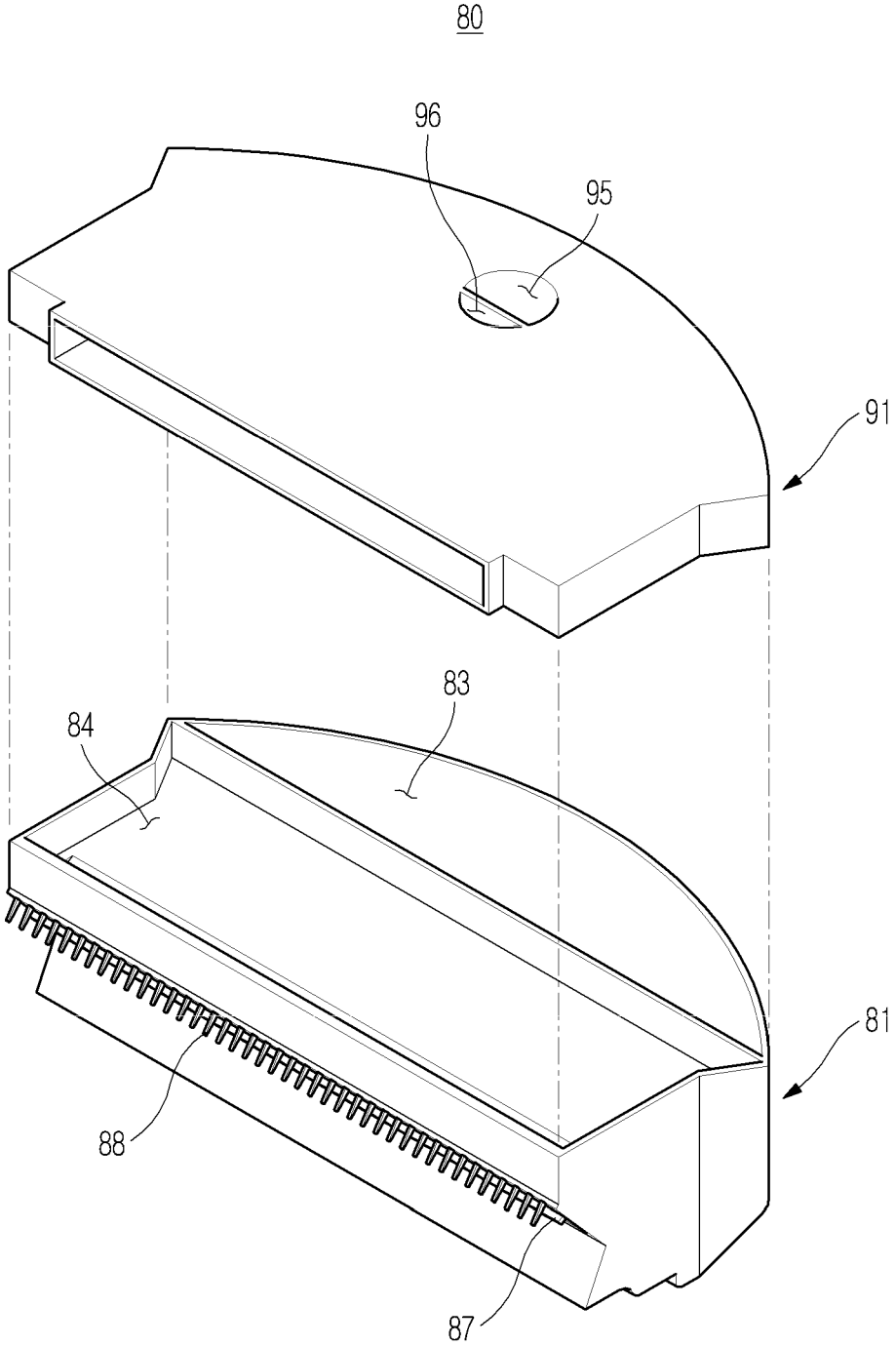
FIG. 4 is a perspective view illustrating an example of a dust collecting unit.

FIG. 4 illustrates a perspective view of the example of the dust collecting unit.

By way of example, FIGS. 1 to 4 show that the dust collecting unit 80 may be detachably mounted behind the brush unit 60, i.e. in a rear region of the body 10. The user may separate the dust collecting unit 80 from the body 10, to wash the dust collecting unit 80, or to remove dust stored in the dust collecting unit 80. Since the dust collecting unit 80 is mounted in the body 10 separately from the blowing unit 70, in other words, since the dust collecting unit 80 has no electronic elements differently from the blowing unit 70, washing of the dust collecting unit 80 may be convenient.

The dust collecting unit 80 may include the dust container 81 and a cover 91. The dust container 81 may have an open upper side, and the cover 91 may be detachably coupled to the upper side of the dust container 81. The user may remove dust stored in the dust container 81 by separating the cover 91.

The interior of the dust container 81 may be divided into the first storage space 83 and the second storage space 84 by a partition 82. The first storage space 83 may serve as a space to store contaminants, such as dust, for example, swept by the brush unit 60, and the second storage space 84 may serve as a space to store fine dust suctioned by the blowing unit 70.

The dust container 81 may include an opening/closing member 85 to open or close the first inlet 83*a* of the first storage space 83. The opening/closing member 85 may be supported by an elastic member 86, such as a torsion spring, to close the first inlet 83*a* after the dust container 81 is separated from the body 10. Although a torsion spring is referred to above as an example of an elastic member, other suitable elastic members may be used as well. When the dust container 81 is mounted into the body 10, the opening/closing member 85 is pressed by an operating arm (not shown) of the body 10, acting to open the first inlet 83*a*. Accordingly, since the opening/closing member 85 closes the first inlet 83*a* when the user separates the dust container 81 from the body 10 to remove dust stored in the dust container 81, it may be possible to prevent or limit the dust from spilling through the first inlet 83*a*.

The dust container 81 may include two ribs protruding from the second inlet 84*a* of the second storage space 84. Of the two ribs, a guide member 87 may be arranged between the first inlet 83*a* and the second inlet 84*a* and may protrude toward the brush unit 60. In one example, the guide member 87 may be tilted in a given direction with respect to a vertical axis direction thereof. The guide member 87 may have a plate shape and may extend in a longitudinal direction of the brush unit 60 so as to enhance suction force.

The other one of the two ribs, i.e. a brush cleaning member 88 may protrude from the second inlet 84*a* toward the brush unit 60. In this case, the brush cleaning member 88 may be tilted in a given direction with respect to a vertical axis direction thereof. The brush cleaning member 88 may have a comb shape and may extend in the longitudinal direction of the brush unit 60 to remove hairs, threads, and the like, wound on the brush 62.

In other words, the guide member 87 substantially lengthens a path of the first inlet 83*a* or of the second inlet 84*a*, but does not come into direct contact with the brush 62. The brush cleaning member 88 comes into direct contact at a predetermined portion thereof with the brush 62 to remove hairs and the like wound on the brush 62. The hairs, etc. removed by the brush cleaning member 88 may be collected into the second storage space 84 through the second inlet 84*a*. Here, the path of the first inlet 83*a* may denote a first dust path F1 to allow the dust collected by the brush unit 60 to be moved into the first storage space 83 through the first inlet 83*a*. The path of the second inlet 84*a* may denote a second dust path F2 to allow the dust suctioned by the blowing unit 70 to be moved into the second storage space 84 through, e.g. the suction path 72 and the second inlet 84*a*. That is, the first dust path F1 may be a path created by the brush unit 60 for movement of contaminants swept by the brush unit 60, and the second dust path F2 may be a path created by the blowing unit 70 for movement of contaminants suctioned/blown by the blowing unit 70.

The cover 91 may define a part of the suction path 72 of the blowing unit 70. The cover 91 may include a communication hole 93 to communicate the suction path 72 and the second storage space 84 with each other. Suction force of the suction path 72 may be applied to the second storage space 84 through the communication hole 93. The cover 91 may further include a filter member 94 installed at the communication hole 93. The filter member 94 filters fine dirt contained in air suctioned into the second storage space 84 while allowing only passage of the air, thereby preventing or limiting the fine dirt from moving toward the blowing unit 70. The cover 91 may include a connection channel 92, which communicates with both the first storage space 83 and the second storage space 84. The connection channel 92 may be divided by a partition 92*a* into a first connection hole 95 communicating with the first storage space 83 and a second connection hole 96 communicating with the second storage space 84. Here, the first connection hole 85 is larger than the second connection hole 96 because the first storage space 83 is larger than the second storage space 84. When the connection holes 95 and 96 are not in use, the connection holes 95 and 96 may be covered with a cap 89. The cap 89 serves to prevent or limit leakage of dust or debris.

Figure 5:
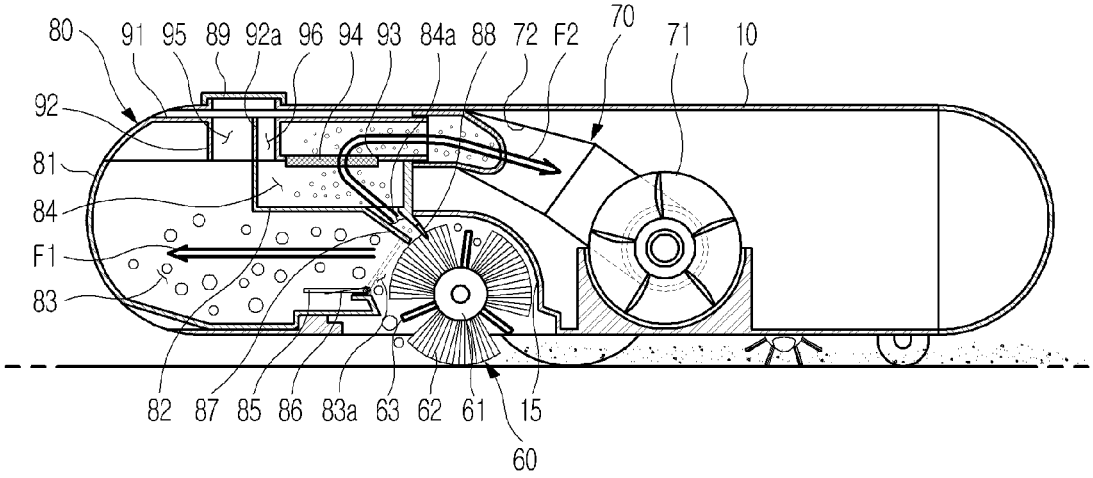
FIG. 5 is a view illustrating an example of a cleaning operation of the robot cleaner.

FIG. 5 illustrates an example of a cleaning operation of the robot cleaner.

As shown in FIGS. 1 to 5, for example, the robot cleaner 1 may remove dust or debris from the floor immediately underneath or around the robot cleaner 1 during traveling of the robot cleaner 1. The brush unit 60 sweeps relatively large dust or debris, and the blowing unit 70 suctions relatively small dust. When the brush 62 sweeps the floor, relatively large dust may be collected into the first storage space 83 through the first inlet 83*a*, and fine dust scattered by the brush 62 may be collected into the second storage space 84 through the second inlet 84*a*. In particular, since the fine dirt floating in air is suctioned into the second storage space 84 through the second inlet 84*a* by suction force of the fan 71, higher suction performance and lower power consumption of the fan 71 can be accomplished as compared to the case wherein the fan 71 directly suctions dust from the floor.

Figure 6:
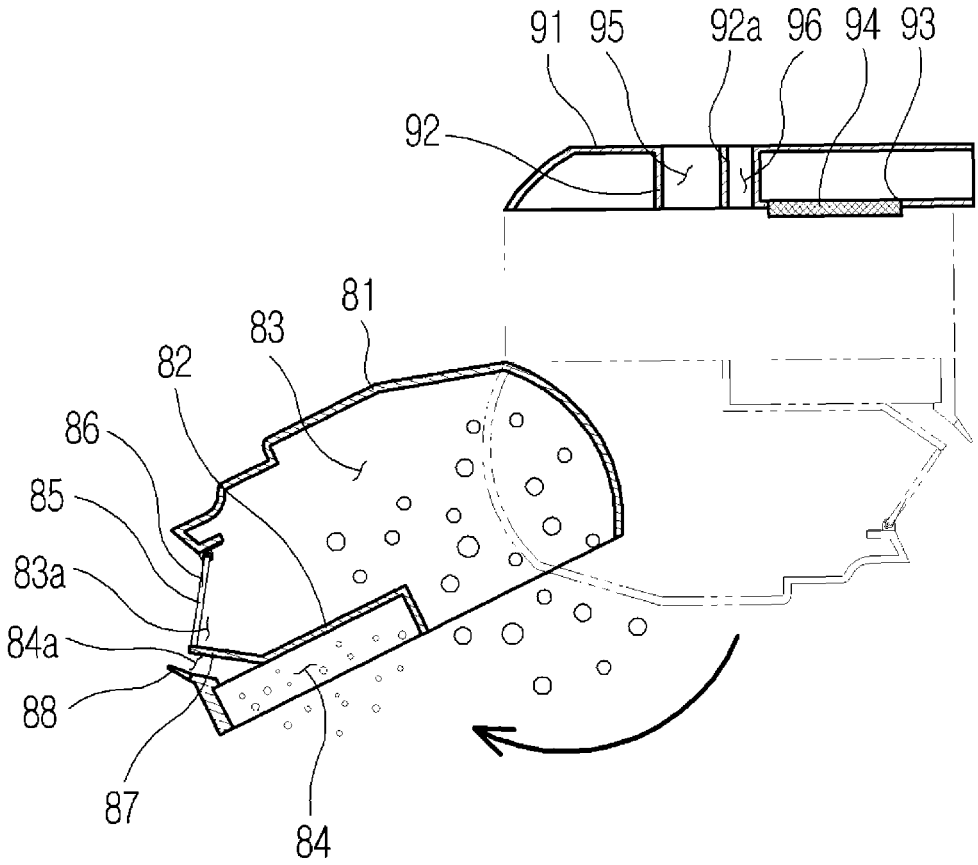
FIG. 6 is a view illustrating an example of a manual operation to remove dust from a dust container.

FIG. 6 illustrates a manual operation to remove dust from the dust container.

As shown in FIGS. 1 to 6, for example, when the robot cleaner 1 completes a cleaning operation or the dust container 81 is full of dust, the user may remove dust or debris from the dust container 81. The dust container 81 may include a sensor to sense the amount of dust, to inform the user of the dust container 81 being full of dust. To manually remove dust or debris from the second storage space 84, the user may separate the dust container 81 from the body 10 and then, may open the cover 91. Since the first inlet 83*a* is closed by the opening/closing member 85 before the cover 91 is opened, it may be possible to prevent or limit the dust from spilling. Moreover, because the fan 71 and the dust container 81 are separated from each other, the user may wash the dust container 81.

Figure 7:
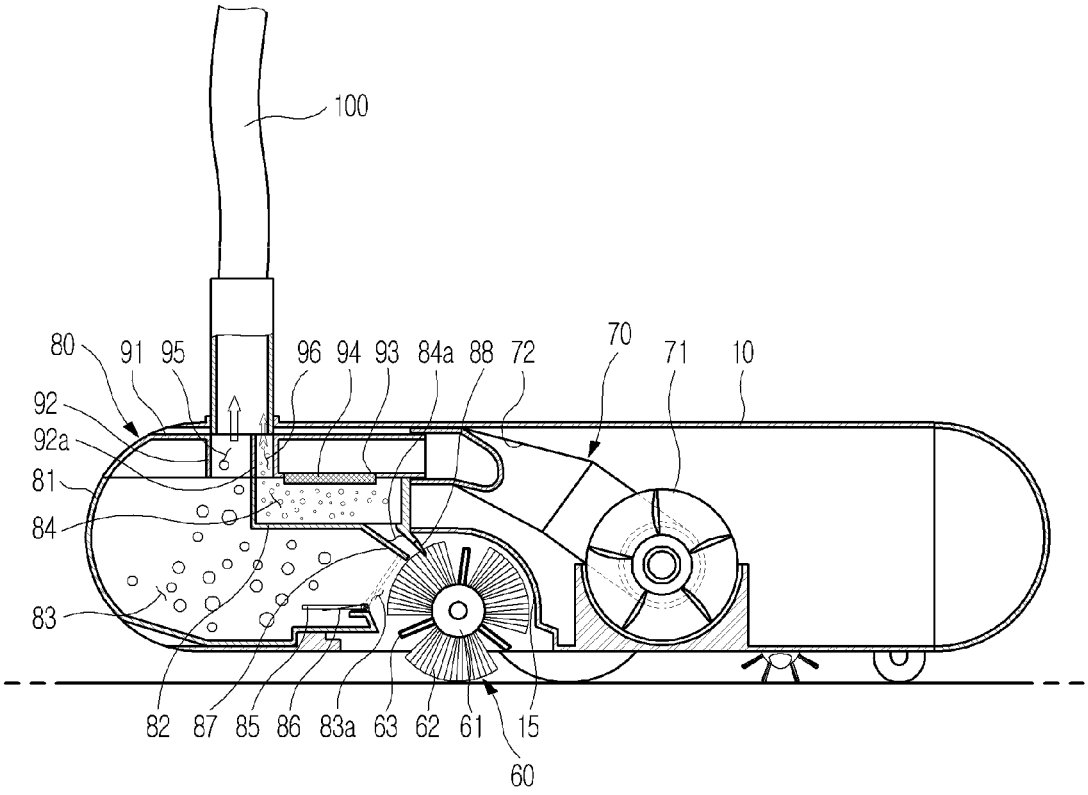
FIG. 7 is a view illustrating an example of an automated operation to remove dust from the dust container.

FIG. 7 illustrates an example of an automated operation to remove dust from the dust container.

By way of example, FIGS. 1 to 7 show that when the robot cleaner 1 completes a cleaning operation or the dust container 81 is full of dust, the user may remove dust or debris from the dust container 81 in an automated manner by use of a dust removal device 100. Specifically, dust or debris stored in the dust container 81 may be removed by suction force of the dust removal device 100. For this, the user may remove the cap 89 and then, connect the dust removal device 100 to the connection holes 95 and 96. In this case, since the connection holes 95 and 96 communicate with the first storage space 83 and the second storage space 84, the dust removal device 100 may remove all or most of the dust or debris stored in the dust container 81.

Figure 8:
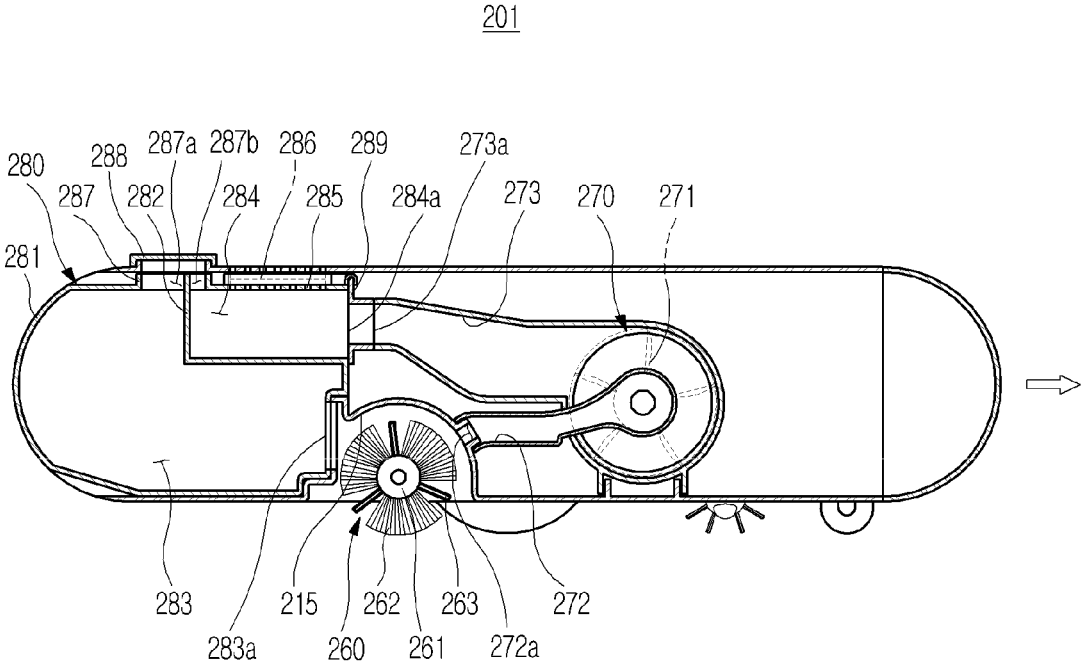
FIG. 8 is a sectional view illustrating a second example of a robot cleaner.

FIG. 8 illustrates a second example of the robot cleaner.

As shown in FIGS. 1, 2, and 8, for example, a robot cleaner 201 includes the body 10, the drive device 20, the cleaning device 30, and the control unit (not shown) in a similar manner as the robot cleaner 1 of FIG. 3. The drive device 20 may include the left drive wheel assembly 21, the right drive wheel assembly 22, and the caster wheel assembly 23. The cleaning device 30 may include the main cleaning assembly 40 and the edge cleaning assembly 50. The robot cleaner 201 shown in FIG. 8 has approximately the same configuration as the robot cleaner 1 shown in FIG. 3 and thus, only differences from the robot cleaner 1 shown in FIG. 3 will be described in detail hereinafter.

The main cleaning assembly 40 may include a brush unit 260, a blowing unit 270, and a dust collecting unit 280. The brush unit 260 may include a motor (not shown), a roller 261, a brush 262, and a flap 263.

The brush 262 may sweep dust or debris from the floor during traveling of the robot cleaner 201. In this case, relatively large dust or debris may be moved rearward of the body 10 and be collected into a first storage space 283 through a first inlet 283*a* of a dust container 281. In addition, when relatively small dust or debris may be scattered and float between the brush unit 260 and a drum case 215, the relatively small dust or debris may be moved forward of the body 10 by suction force of the blowing unit 270 and be collected into a second storage space 284 through a second inlet 284*a* of the dust container 281. That is, the fine dirt is first moved forward of the body 10 and thereafter, is moved rearward of the body 10, thereby being collected into the second storage space 284 through the second inlet 284*a* of the dust container 281.

The blowing unit 270 may be arranged in front of the brush unit 260, i.e. in the front region of the body 10. The blowing unit 270 may include a fan 271, a suction path 272, a suction port 272*a*, an exhaust path 273, and an exhaust port 273*a*. The fan 271 may be driven by a motor (not shown), and may include a bypass impeller. The fan 271 is arranged between the suction path 272 and the exhaust path 273, to suction contaminants through the suction path 272 and to move the suctioned contaminants through the exhaust path 273. In particular, the suction path 272 may extend forward from the brush unit 260 to the blowing unit 270, and the exhaust path 273 may extend rearward from the blowing unit 270 to the brush unit 260. The suction port 272*a* may serve as an entrance of the drum case 215 to allow the dust or debris scattered between the brush unit 260 and the drum case 215 to be moved into the suction path 272. The exhaust port 273*a* may serve as an exit facing the second inlet 284*a* to allow the dust or debris to be moved from the exhaust path 273 to the second storage space 284.

The dust collecting unit 280 may be installed behind the brush unit 260, i.e. in the rear region of the body 10. The dust collecting unit 280 is provided separately from the blowing unit 270 and may be detachably mounted to the body 10. The user may separate the dust collecting unit 280 from the body 10 to wash the dust collecting unit 280 or to remove dust from the dust collecting unit 280. Since the dust collecting unit 280 has no electronic elements differently from the blowing unit 270, the user may wash the dust collecting unit 280.

Figure 9:
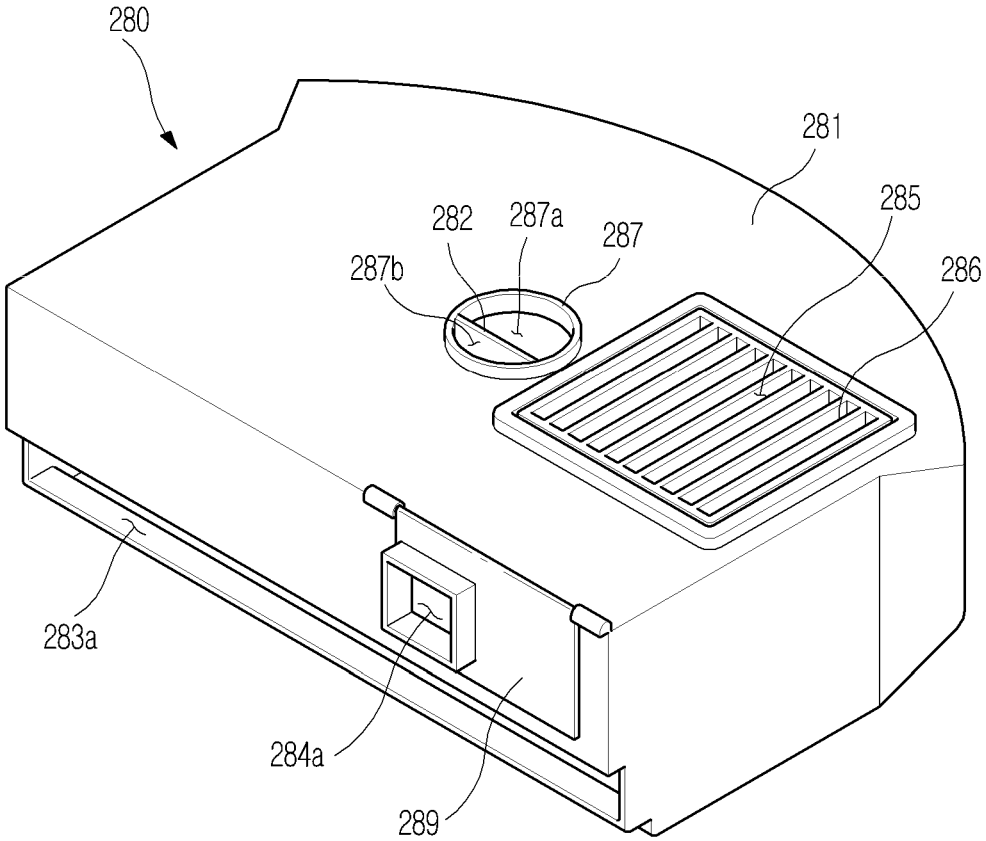
FIG. 9 is a perspective view illustrating the second example of a dust collecting unit.

FIG. 9 illustrates a perspective view of the second example of the dust collecting unit.

As shown in FIGS. 1, 2, 8 and 9, for example, the dust collecting unit 280 may include a dust container 281, a filter member 286, a cover 289, and a connection hole 287.

The dust container 281 is detachably coupled to the body 10 and may define an outer wall of the body 10. The interior of the dust container 281 is divided into the first storage space 283 and the second storage space 284 by a partition 282. The first storage space 283 may serve as a space to store relatively large dust or debris, and the second storage space 284 may serve as a space to store relatively small dust or debris, i.e. fine dirt. The first storage space 283 is located below the second storage space 284, and has a larger volume than the second storage space 284. The first storage space 283 communicates with the first inlet 283*a* to store dust or debris swept by the brush unit 260. The second storage space 284 communicates with the second inlet 284*a* to store dust or debris scattered and suctioned/blown by the brush unit 260 and the blowing unit 270. Here, a path to allow the dust swept by the brush unit 260 to be collected into the first storage space 283 through the first inlet 283*a* is called the first dust path F1, and a path to allow the dust suctioned by the blowing unit 270 to be collected into the second storage space 284 through the suction path 272, the exhaust path 273, the exhaust port 273*a* and the second inlet 284*a* is called the second dust path F2. That is, the first dust path F1 may be a path created by the brush unit 260 for movement of contaminants swept by the brush unit 260, and the second dust path F2 may be a path created by the blowing unit 270 for movement of contaminants suctioned/blown by the blowing unit 70.

Since the second storage space 284 communicates with the blowing unit 270, the dust container 281 may have an outlet 285 formed in the top thereof to discharge air blown by the blowing unit 270. A filter member 286 is installed at the outlet 285 to discharge purified air through the outlet 285. Fine duty suctioned through the suction port 272*a* may be discharged by way of the filter member 286 of the dust collecting unit 280 after passing through the fan 271 of the blowing unit 270.

The connection hole 287 may be formed in the top of the dust container 281 and may include a first connection hole 287*a* and a second connection hole 287*b*. The first connection hole 287*a* may communicate with the first storage space 283, and the second connection hole 287*b* may communicate with the second storage space 284. Assuming use of a separate dust removal device 290 that will be described hereinafter, the user connects the dust removal device 290 to the dust container 281 through the connection hole 287, so as to remove dust or debris from the dust container 281 in an automated manner by use of vacuum suction force of the dust removal device 290. When the use of the connection hole 287 is unnecessary, the connection hole 287 may be covered with a cap 288, to prevent dust or debris from spilling out of the dust container 281.

The dust container 281 may include the cover 289 to open or close the second storage space 284. When the dust container 281 is mounted in the body 210, the cover 289 closes a part of the second storage space 284. In this case, contaminants moved by the blowing unit 270 may be introduced into the second storage space 284 through the second inlet 284*a* formed in the cover 289. On the other hand, when the user separates the dust container 281 from the body 10 for removal of dust, the user may remove contaminants stored in the second storage space 284 by opening the cover 289. The dust or debris stored in the first storage space 283 may be easily removed through the first inlet 283*a*.

Figure 10:
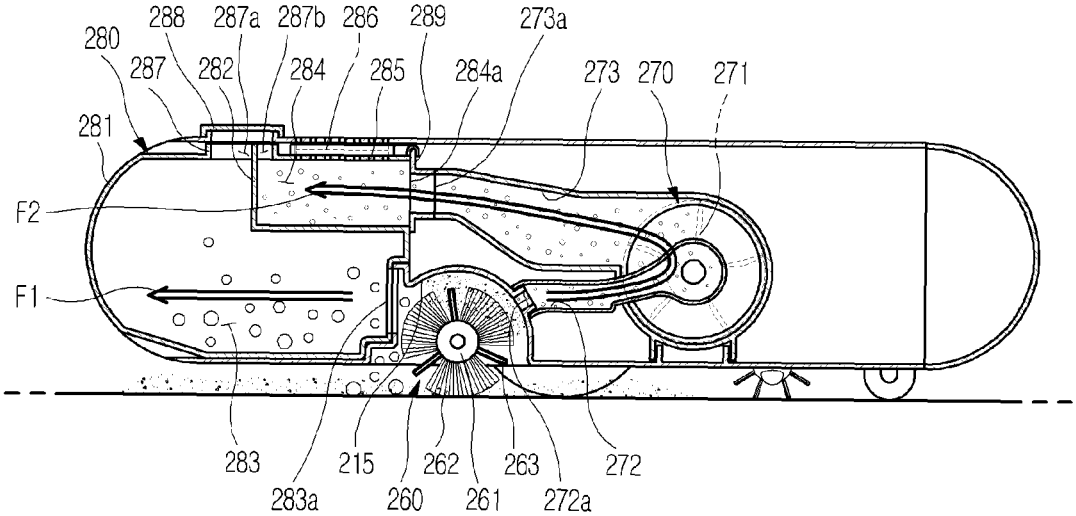
FIG. 10 is a view illustrating a second example of a cleaning operation of the robot cleaner according.

FIG. 10 illustrates a second example of a cleaning operation of the robot cleaner.

As shown in FIGS. 1, 2, and 8 to 10, for example, the robot cleaner 201 may remove dust or debris from the floor immediately underneath or around the robot cleaner 201 during traveling of the robot cleaner 201. The brush unit 260 may sweep relatively large dust or debris, and the blowing unit 270 may suction relatively small dust. When the brush 262 sweeps the floor, dust or debris may be collected into the first storage space 283 through the first inlet 283*a*. Dust or debris scattered by the brush 262 may be suctioned into the suction port 272*a* by the fan 271 and thereafter, may be collected into the second storage space 284 through the second inlet 284*a*.

Since the second storage space 284 communicates with the outside through the outlet 285 and the filter member 286 may be installed at the outlet 285, it may be possible to prevent or limit leakage of the dust or debris stored in the second storage space 284 and to allow only purified air having passed through the filter member 286 to be discharged to the outside. Also, it may be possible to prevent or deter the fan 271 from being suddenly stopped or breaking down due to contaminants trapped therein since the fan 271 suctions fine dust scattered by the brush 262, and the filter member 286 may have no direct effect on performance of the fan 271 since the filter member 286 is installed to the dust container 281 while being spaced apart from the fan 271. Sufficient performance of the fan 271 may enhance cleaning performance, and cleaning efficiency may be maintained even when the fan 271 is driven by low power for suction of fine dust.

Figure 11:
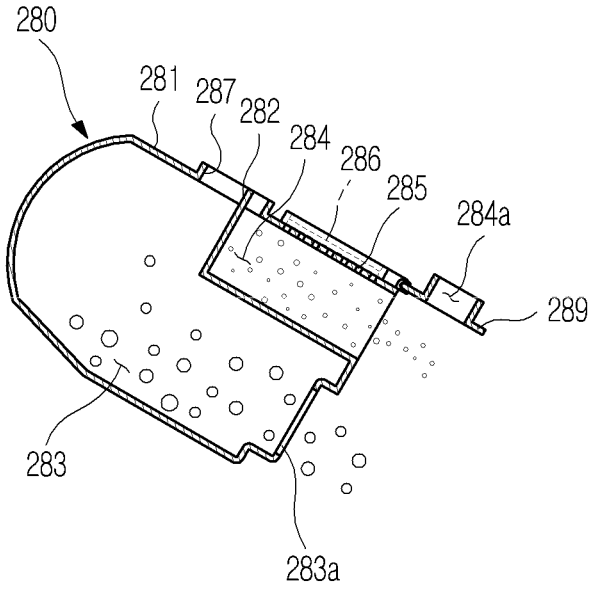
FIG. 11 is a view illustrating a second example of a manual operation to remove dust from a dust container.

FIG. 11 illustrates a second example of a manual operation to remove dust from the dust container.

As shown in FIGS. 1, 2, and 8 to 11, for example, when the robot cleaner 201 completes a cleaning operation or the dust container 281 is full of dust, the user may remove dust or debris from the dust container 281. To manually remove dust or debris from the first storage space 283 through the first inlet 283*a*, the user may separate the dust container 281 from the body 10. Also, the user may remove dust or debris from the second storage space 284 by opening the cover 289. Since the fan 271 and the dust container 281 may be mounted to the body 10 separately from each other, the user may separate only the dust container 281 from the body 210 so as to wash the dust container 281.

Figure 12:
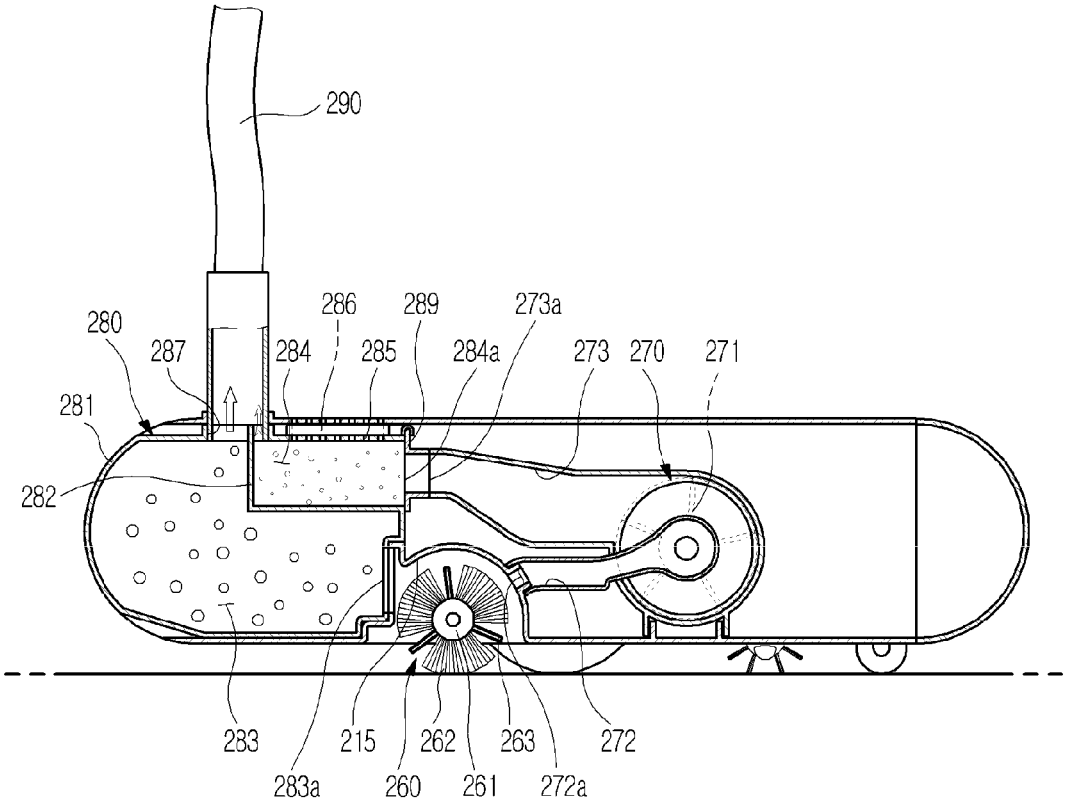
FIG. 12 is a view illustrating a second example of an automated operation to remove dust from the dust container.

FIG. 12 illustrates a second example of an automated operation to remove dust from the dust container.

As shown by the examples in FIGS. 1, 2, and 8 to 12, when the robot cleaner 201 completes a cleaning operation or the dust container 281 is full of dust, the user may remove dust or debris from the dust container 281 in an automated manner by use of a dust removal device 290. The user may remove the cap 288 and then, connect the dust removal device 290 to the connection hole 287, so as to remove dust or debris from the dust container 281 by suction force of the dust removal device 290. In this case, since the first connection hole 287*a* communicates with the first storage space 283 and the second connection hole 287*b* communicates with the second storage space 284, the dust removal device 290 may remove most or all the dust or debris stored in the dust container 281.

As is apparent from the above description, a cleaning method using various units of a cleaning apparatus may be optimized according to a size of contaminants, realizing a low power cleaning apparatus.

In addition, the examples of the cleaning apparatus described above may have an improved configuration to provide convenient removal of collected contaminants.

Further, reliability of cleaning performance may be accomplished by preventing or reducing the likelihood of breakdown of the units due to obstacles.

Furthermore, the cleaning performance may be further enhanced with improved arrangement of the units.

A number of examples have been described above. Nevertheless, it will be understood that various modifications may be made. For example, suitable results may be achieved if the described techniques are performed in a different order and/or if the components in a described system, architecture, device, circuit or apparatus are combined in a different manner and/or replaced or supplemented by other components or their equivalents. Accordingly, other implementations are within the scope of the following claims.

What is claimed is:

1. A cleaning apparatus comprising:

a body;

a brush unit rotatably provided at a central region of the body;

a blowing unit provided in a front region of the body to provide suction force; and a dust collecting unit provided in a rear region of the body to store dust, wherein:

the dust collecting unit includes a first inlet provided on a first dust path created by the brush unit, and a second inlet provided on a second dust path created by the blowing unit, and the dust collecting unit includes a guide member arranged between the first inlet and the second inlet and configured to extend toward the brush unit.

2. The cleaning apparatus according to claim 1, wherein the first inlet and the second inlet are arranged adjacent to each other, and the second inlet is positioned higher than a rotation center of the brush unit.

3. The cleaning apparatus according to claim 2, wherein the first inlet and the second inlet are arranged to face the brush unit.

4. The cleaning apparatus according to claim 1, wherein the guide member is installed in a longitudinal direction of the brush unit and has a plate shape.

5. The cleaning apparatus according to claim 1, wherein the guide member is installed in a longitudinal direction of the brush unit and has a comb shape.

6. The cleaning apparatus according to claim 1, wherein the guide member is tilted by a predetermined angle with respect to a vertical axis direction thereof.

7. The cleaning apparatus according to claim 1, wherein:

the blowing unit further includes a suction port provided on the second dust path; and the first inlet and the suction port are arranged at opposite sides of the brush unit.

8. The cleaning apparatus according to claim 1, wherein:

the dust collecting unit includes a discharge port; and air introduced into the dust collecting unit by the blowing unit is discharged out of the body through the discharge port.

9. The cleaning apparatus according to claim 8, wherein the dust collecting unit includes a filter member installed at the discharge port.

10. A cleaning apparatus comprising:

a body;

a brush unit rotatably provided at a central region of the body;

a blowing unit provided in a front region of the body to provide suction force; and a dust collecting unit provided in a rear region of the body to store dust, wherein:

the dust collecting unit includes a first inlet provided on a first dust path created by the brush unit, and a second inlet provided on a second dust path created by the blowing unit, and the dust collecting unit includes a brush cleaning member protruding from the second inlet and having a predetermined portion to interfere with the brush unit.

11. The cleaning apparatus according to claim 10, wherein the brush cleaning member is installed in a longitudinal direction of the brush unit and has a comb shape.

12. The cleaning apparatus according to claim 10, wherein the brush cleaning member is tilted by a predetermined angle with respect to a vertical axis direction thereof.

13. A cleaning apparatus comprising:

a body;

a brush unit rotatably provided at a central region of the body;

a blowing unit provided in a front region of the body to provide suction force; and a dust collecting unit provided in a rear region of the body to store dust, wherein:

the dust collecting unit includes a first inlet provided on a first dust path created by the brush unit, and a second inlet provided on a second dust path created by the blowing unit, the dust collecting unit further includes a first storage space provided on the first dust path, a second storage space provided on the second dust path, and a partition to separate the first storage space and the second storage space from each other, and the dust collecting unit further includes a cover arranged above the first storage space and the second storage space; and the cover includes a communication hole to communicate the second storage space and the blowing unit with each other.

14. The cleaning apparatus according to claim 13, wherein the cover further includes a filter member installed at the communication hole.

15. A cleaning apparatus comprising:

a body;

a brush unit rotatably provided at a central region of the body;

a blowing unit provided in a front region of the body to provide suction force; and a dust collecting unit provided in a rear region of the body to store dust, wherein:

the dust collecting unit includes a first inlet provided on a first dust path created by the brush unit, and a second inlet provided on a second dust path created by the blowing unit, the dust collecting unit further includes a first storage space provided on the first dust path, a second storage space provided on the second dust path, and a partition to separate the first storage space and the second storage space from each other, the dust collecting unit further includes a cover arranged above the first storage space and the second storage space; and the cover includes a connection channel having a first connection hole communicating with the first storage space and a second connection hole communicating with the second storage space.

16. The cleaning apparatus according to claim 15, wherein the first storage space is larger than the second storage space and the first connection hole corresponding to the first storage space is larger than the second connection hole corresponding to the second storage space.

17. A cleaning apparatus comprising:

a body;

a brush unit rotatably provided at a central region of the body;

a blowing unit provided in a front region of the body to provide suction force; and a dust collecting unit provided in a rear region of the body to store dust, wherein:

the dust collecting unit includes a first inlet provided on a first dust path created by the brush unit, and a second inlet provided on a second dust path created by the blowing unit, and the dust collecting unit further includes an opening/closing member to open or close the first inlet and an elastic member to elastically support the opening/closing member.

18. The cleaning apparatus according to claim 17, wherein the opening/closing member opens the first inlet when the dust collecting unit is mounted into the body and closes the first inlet when the dust collecting unit is separated from the body.

19. A cleaning apparatus comprising:

a body;

a brush unit rotatably provided at a central region of the body;

a blowing unit provided in a front region of the body to provide suction force; and a dust collecting unit provided in a rear region of the body to store dust, wherein:

the dust collecting unit includes a first inlet provided on a first dust path created by the brush unit, and a second inlet provided on a second dust path created by the blowing unit, the blowing unit guides contaminants, such as dust, scattered by the brush unit, into the dust collecting unit, and the blowing unit includes a suction path communicating with the brush unit, an exhaust path communicating with the dust collecting unit, and a fan arranged between the suction path and the exhaust path.

20. The cleaning apparatus according to claim 19, wherein a flow direction of the suction path is opposite to a flow direction of the exhaust path.

* * * * *